United States Patent [19]

Golz

[11] 4,168,902

[45] Sep. 25, 1979

[54] APPARATUS FOR PEELING OFF THE LEADING EDGE OF A RECEIVING SHEET FROM A TRANSFER IMAGE CARRIER

[75] Inventor: Horst Golz, Wedel, Fed. Rep. of Germany

[73] Assignee: Lumoprint Zindler KG (GmbH & Co.), Hamburg, Fed. Rep. of Germany

[21] Appl. No.: 834,471

[22] Filed: Sep. 19, 1977

[30] Foreign Application Priority Data

Sep. 23, 1976 [DE] Fed. Rep. of Germany ..... 2642707

[51] Int. Cl.[2] ..... G03G 15/00

[52] U.S. Cl. ..... 355/3 R; 118/245; 271/DIG. 2; 271/174; 432/60

[58] Field of Search ..... 271/174, DIG. 2; 118/60, 245; 432/60; 355/3 R

[56] References Cited

U.S. PATENT DOCUMENTS 3,844,252 10/1974 Thettu ..... 432/60 X 3,938,950 2/1976 Weiler ..... 118/245 X

*Primary Examiner*—Richard A. Schacher

*Attorney, Agent, or Firm*—Toren, McGeady and Stanger

[57] ABSTRACT

An apparatus for peeling off the leading edge of a sheet of paper adhering to a moving transfer image carrier during the process of transferring a powder image onto the sheet. The apparatus includes one stripper member or a plurality such as three stripper members mounted in the vicinity of the transfer image carrier at the side on which the sheet is intended to be detached from the same. The one or several stripper members engage the moving sensitive surface of the image carrier at a balanced extremely low contact pressure and are adapted to be lifted off this surface by a peeled-off sheet of copying material. The strippers are continuously reciprocated in a direction transversely of the transfer image carrier and thereby likewise transversely of the advancing sheet so that the problem of traces that may be engraved into the surface of the transfer image carrier is virtually overcome and the useful life of the image carrier is substantially extended.

14 Claims, 9 Drawing Figures

Fig.5
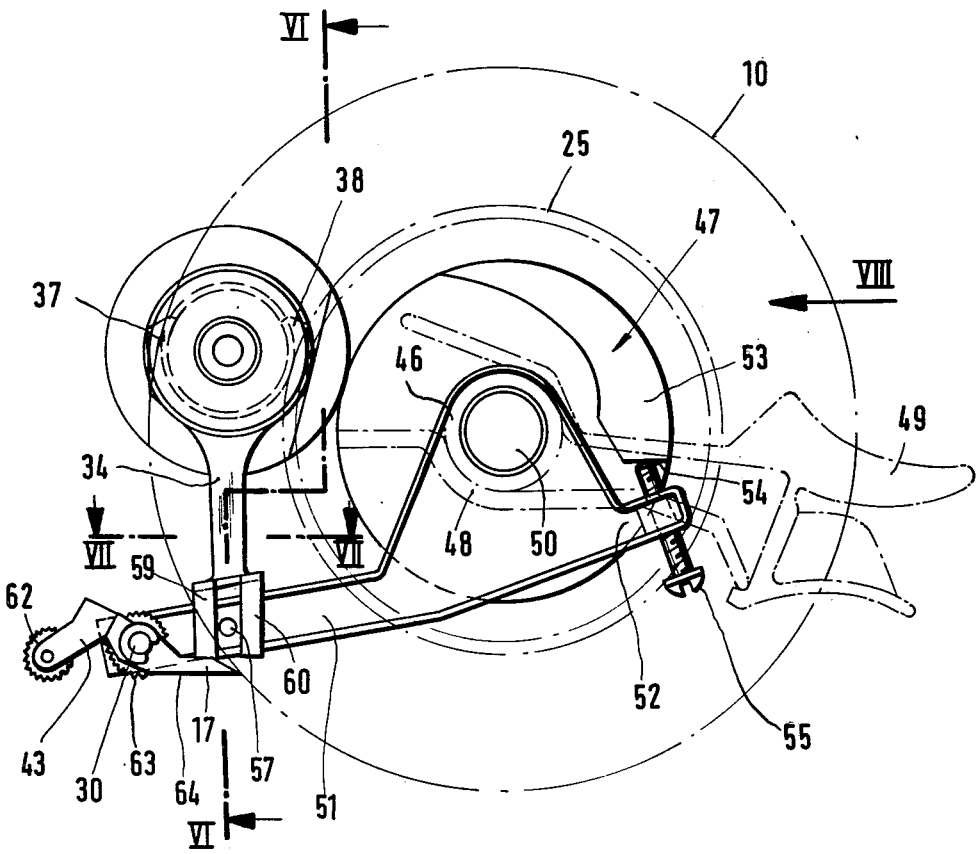
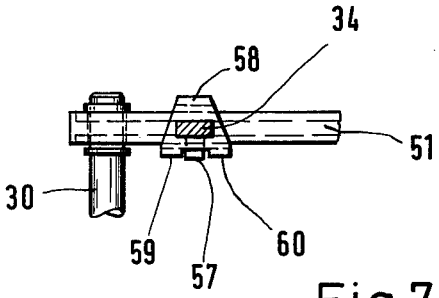
Fig.7

Fig. 6
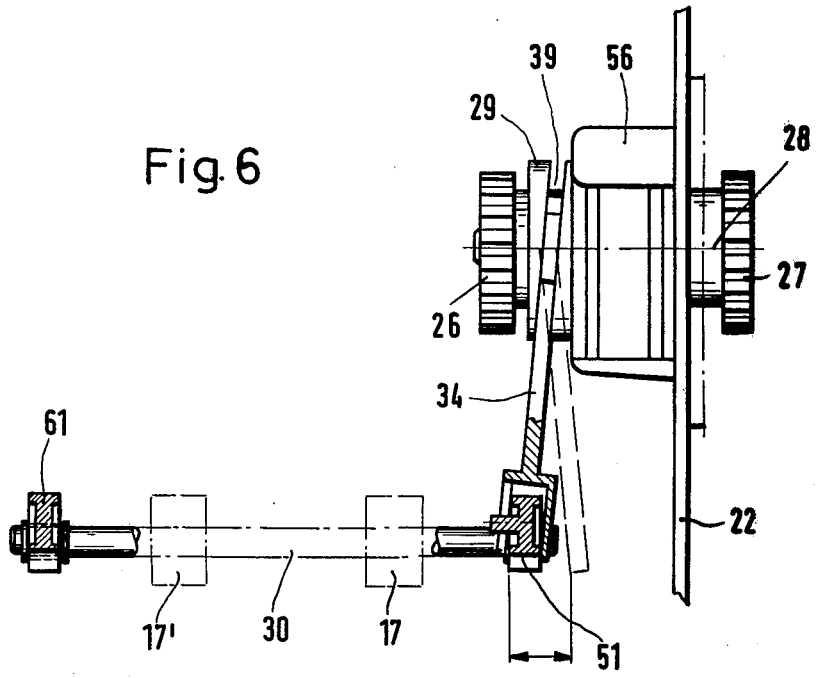
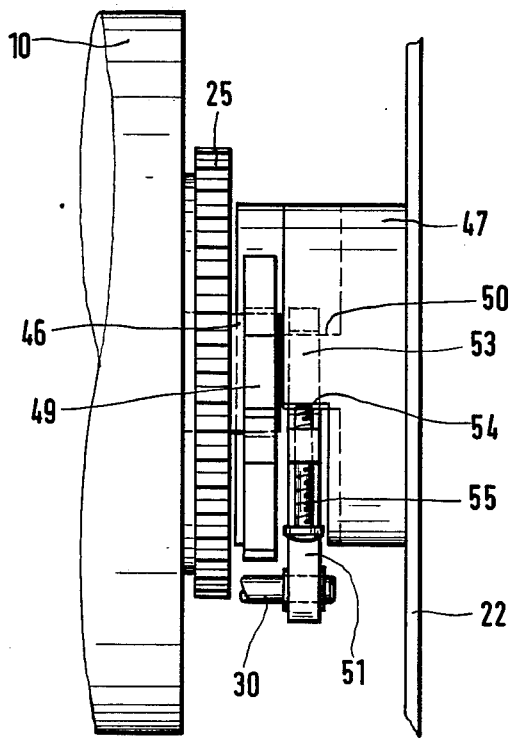
Fig. 8

APPARATUS FOR PEELING OFF THE LEADING EDGE OF A RECEIVING SHEET FROM A TRANSFER IMAGE CARRIER

The present invention relates generally to copying machines and more particularly to an apparatus for peeling off the leading edge of a receiving sheet from a transfer image carrier in a copying machine wherein at least one stripper or several strippers are arranged across the width of the receiving sheet or the transfer image carrier and serve to at least temporarily engage the transfer image carrier before the leading edge of the receiving sheet arrives.

In an arrangement of this type the transfer image carrier may consist of a driven drum having a coating on which may be generated, by an exposure, a latent image adapted to be developed, particularly by an electro-photographical process. The respective coatings may e.g. consist substantially of selenium.

It is known that trnsfer image carriers of this type are sensitized by an electrical charge, in order to generate a latent image that will be formed by direct exposure of image. Developer powder is spread on the latent image for developing the same. The developed image is optionally transferred to a receiving sheet that is guided along the transfer image carrier, optionally in employing an electrical field. The receiving sheet generally adheres, due already to the forces existing between the materials. An engagement by rollers, however, is not excluded. There now exists the problem of removing, after image transfer, the receiving sheet which for the purposes of the present invention is primarily a normal sheet of paper but under different process conditions may likewise consist of a sheet of treated or coated paper, from the transfer image carrier, particularly the drum.

The present invention relates more generally to a copying machine and particularly to a copying machine that is based on the electro-photographical process and includes all parts that are necessary to the operation of a copying machine of this type.

By the U.S. Pat. No. 3,062,108 and the German Laying-Open specifications Nos. 2,359,835 and 2,047,701 there are already known machines of this type operating according to the electro-photographical process. The general characteristics of machines of this type are claimed within the scope of the present invention. The above indicated three patents relate to the stripping device or respectively the separation of the receiving sheet from the transfer image carrier.

It may be taken for granted as being known to enhance such a separation by vacuum effects. This is complicated. The devices of the three above cited patents include strippers.

With strippers it is already known that these strippers may cause effects in the coating of the transfer image carrier such as the selenium layer when contacting this coating. These effects are intended to be reduced. This applies particularly to an embodiment according to the above cited U.S. Pat. No. 3,062,108 according to which a stripper is being urged, by a cam controller, against the drum having a xerographically sensitive surface. This stripper comprises several fingers that are moved in the same directions. In an arrangement of this type in which one or several strippers may be moved cyclically toward or away from the drum wall forming the transfer image carrier, there will arise the drawback that this movement already requires the presence of feed forces in the directions of movement. This causes contact pressures during engagement. By this contact pressure which results from the movement, the surface of the transfer image carrier is being disturbed to a relatively strong degree. The approaching movement entrains the further drawback that any particles, surface roughnesses or the like that are present or may be trapped between the approaching parts cause stronger trace effects.

An increased trace effect, furthermore, will be obtained always if a stripper adapted to be lifted away by a positive control mechanism or being virtually permanently engaged always acts on one and the same circumferential line of the drum. By this fact the useful life of the transfer image carrier is substantially reduced.

In the two other patents, i.e. in the German Laying-Open specifications Nos. 2,359,835 and 2,047,701, there are likewise provided strippers that are actuatable by a positive control mechanism and adapted to be pivoted in a radial direction toward and away from the drum. These strippers are active within a region away from the transfer image carrier.

In the German Laying-Open specification No. 2,047,701 a curved mounting disc with the transfer image carrier includes a recess or opening in a drum, and the leading edge of the receiving sheet projects beyond the leading edge of the transfer image carrier. This already necessitates a complicated control mechanism. The at least one stripper is moved, by rather complicated control mechanisms, between two positions in the region of the recess or opening of the transfer image carrier.

A similar arrangement is shown in the German Laying-Open specification No. 2,359,835 according to which a roll film as a transfer material is provided on the drum and adapted to be deflected into the interior of the drum whereby the stripper is active at this opened drum portion.

According to these heretofore known arrangements the design of the apparatus is rather complicated by a special arrangement of the transfer image carrier whereby it is intended to prevent the strippers as far as possible from acting on the transfer image carrier.

The present invention relates to an embodiment in which the strippers perform their function at the transfer image carrier. A drum includes a wall surface that is uninterrupted in the circumferential direction, and this is advantageous to the assembly and the control of the apparatus.

The invention relates primarily but not exclusively to a drum-shaped transfer image carrier having a continuous wall surface. Although the invention does not exclude that strippers are moved cyclically toward this wall surface for being effective at the correct time, the invention primarily relates to an embodiment in which several strippers disposed side by side engage the surface of the transfer image carrier, particularly the wall surface of the drum. This is advantageous in that by special means may be provided an extremely sensitively controlled sufficient engagement that is adapted to the function but excludes a contact pressure caused by a reciprocating positive control mechanism. By an almost permanent or respectively a permanent engagement of this type there will be excluded that frictional roughnesses or particles entrapped between stripper and surface of the transfer image carrier may have a deleterious effect. In such an arrangement it is not excluded that particularly with parallel movements of the transfer image carrier, particularly the rotation of a drum, there may be generated traces during extended usage.

It is the object of the present invention to provide a novel and improved apparatus for peeling off the leading edge of a receiving sheet from a transfer image carrier.

It is another object of the present invention to provide an apparatus of the above type having the described characteristics in which apparatus the generation of traces of this type is reduced to a minimum, in thereby increasing the useful life of the transfer image carrier.

This object is achieved, in accordance with the present invention, by the improvement that the at least one stripper is mounted so as to be transversely movable with respect to the transfer image carrier, and there are provided drive means for moving the at least one stripper during its engagement with the moving transfer image carrier in an oscillating manner transversely of the feed direction. By this reciprocating movement the formation of traces is surprisingly reduced to a considerable degree and, with a corresponding design, by evenly affecting the transfer image carrier across the whole width thereof, is made neglegibly small, in achieving an increased useful life. In a drum-shaped transfer image carrier the at least one stripper is mounted on an axis that is adapted to be reciprocated with respect to the drum in directions parallel of the longitudinal direction of the drum. In this context, the lateral movability of the strippers may be controlled with respect to the rotation of the drum wall surface so that no unaltered tracks of the stripper may appear along the drum wall surface but the resulting intersections of the engagement traces will progress about the circumference of the drum.

The stated arrangement with a reciprocable axis is especially advantageous. It should be pointed out, however, that the invention likewise includes different solutions. Thus strippers may be mounted individually on lugs aligned with the drum and may be moved oscillatingly by actuating linkages so that the stripper ends which engage permanently the drum move to and fro along the drum wall surface in a direction parallel of the axial direction of the drum. The drive means may consist of the drive means indicated below for the axis, or of special actuating elements optionally formed by tapes and movable to and fro by reversible motors.

When employing the reciprocating axis, the drive means on a drive shaft that is optionally in a predetermined driving relationship with respect to the drum drive means, preferably consists of a cam disc in which is guided a guide member for the reciprocating strippers. The term "drive shaft" relates in this context to a drive shaft that is provided in the machine, such as a drive shaft on a side plate, and this drive shaft rotates when the drum-shaped transfer image carrier is driven.

Preferably, the cam disc includes a guide slot that is inclined with respect to the axis of the cam disc, and a fork is movable along this guide slot. An opposite end of the fork is movably connected to the axis and reciprocates this axis under the control of the rotating cam disc. If the fork is anchored in the cam disc by a semi-segment, the fork may likewise serve as a support for one side of the axis. A support of this type is advantageous for providing, in combination with a corresponding arrangement of the cam disc, not only an axial movement but likewise an oscillating movement in the circumferential direction of the drum.

It is especially preferred to provide the axis on swivel arms and to associate with these swivel arms abutments against which may be adjusted the swivel arm direction by an adjustment screw. In this manner the strippers may be adjusted with an extremely high precision. It is particularly preferred that the strippers are pivotably mounted on the axis, and engagement against the drum surface is effected by an extension of the strippers facing away from the drum. By this swivel movement of the strippers on the axis and likewise by the directional positioning of the swivel arms, there may be selected precisely the engagement location at the circumference of the drum.

Preferably are provided abutments and adjustment screws in a manner so that the swivel levers at their ends bearing the strippers are movable in the sense of rotation of the periphery of the drum.

According to another advantageous embodiment the axis is reciprocally mounted in bearings, and several strippers are mounted on this axis. With this arrangement, the engagement point of the strippers on the circumference of the drum is fixed.

The projecting end of the strippers facing away from the drum defines a counter-weight for permanently engaging the strippers with the drum wall surface. This results in a surprisingly simple arrangement whereby especially the engagement may be adjusted with an extremely sensitive precision, particularly when a movable counter-weight is provided on the projecting end. This constitutes an advantageous characteristic of the present invention because a permanently engaging stripper with mere engagement contact prevents frictional particles from being trapped whereby according to the essential characteristic of the invention this stripper continuously alters its track on the transfer image carrier. With this solution complicated control mechanisms are eliminated so that functional breakdowns resulting therefrom are likewise eliminated.

According to a particularly preferred embodiment a toothed wheel is arranged at the extension opposite the stripper with respect to the axis, and a stripped receiving sheet may advance toward this toothed wheel whereby the receiving sheet, due to its inherent rigidity, lifts the stripper away from the drum wall surface during the passage of the paper. This arrangement is assisted by the highly sensitively adjustable engagement of the stripper whereby this engagement is adjusted so as to be sufficient for leading away an approaching receiving sheet. In this manner, temporary lift-off of the strippers from the wall surface of the drum is achieved without a positive control mechanism. The cam surface is, therefore, additionally releaved, without requiring, toward this end, any special control means.

This indicated effect may be enhanced by an additional toothed wheel that is associated with each stripper in the region of its pivot mounting on the axis, and which projects beyond the downwardly facing stripper surface along which the receiving sheet is being removed. By this arrangement will be avoided particularly the formation of tracks on the receiving sheet prior to fixation. The same purpose is served by the wheels in the form of toothed wheels, and optionally these wheels may be provided with peripheral needles.

The above mentioned movable connection may consist of a swivel connection. Advantageously and especially in a pivotable suspension of the axis the connection permits vertical movements between the fork and an axis-supporting member, particularly a swivel arm, and this connection need not be restricted with respect to relative vertical movements if the swivel arms are provided with adjustment screws and there are provided abutments. This connection may also include a swivel arm whereby are provided a web on one side of the swivel arm, and two spaced webs on the opposite side of the swivel arm, and a projection of the swivel arm is movable in between these webs.

Another characteristic of a simple design resides in the fact that the drive shaft is driven in dependence upon the rotary speed of the drum.

In the following, the present invention will be described more in detail with reference to advantageous illustrative embodiments shown in the appended drawings. In these drawings:

FIG. 5 is a schematical lateral elevational view of another preferred embodiment of the present invention whereby the journalling side plates are omitted for clarity;

FIG. 6 is a fragmentary sectional view along the line VI—VI of FIG. 5;

FIG. 7 is a sectional view along the line VII—VII of FIG. 5;

FIG. 8 is a view corresponding to the arrow VIII of FIG. 5; and

Figure 1:
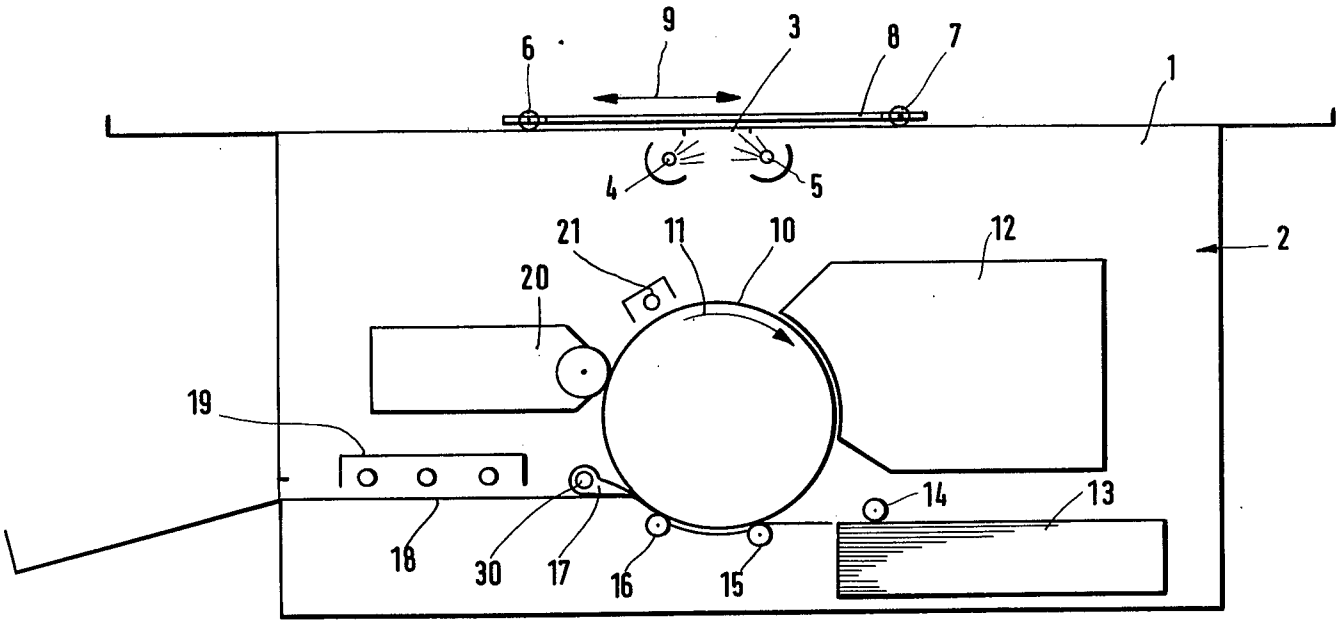
FIG. 1 is a schematical lateral elevational view of a copying machine.

Referring to FIG. 1, the copying machine 1 includes a housing 2 having in its top wall an exposure slot 3 with associated exposure light sources 4, 5. An original holder in the form of a transparent plate 8 may be reciprocated in the directions indicated by the double-headed arrow 9 along the top wall of the housing by means of guides and rails and optionally rollers 6, 7. Below the exposure slot 3 is rotatably mounted, in side plates extending parallel of the plane of the drawing, a driven drum-type transfer image carrier 10 which includes e.g. a selenium layer. This transfer image carrier may be exposed through the exposure slot 3. The transfer image carrier rotates in the direction of the arrow 11 whereby its movement is synchronized with the movement of the plate 8. Beyond the apex of the transfer image carrier at which the direct exposure is effected and in the direction of rotation is arranged a developing station 12 with a powder applying device, for developing an exposed latent image. This latent image is transferred to a receiving sheet that is guided toward the drum circumference according to working cycles from a stack 13 by a controlled withdrawing device 14, in optionally being supported by rollers 15, 16. By strippers 17—and the invention relates particularly to these strippers—this sheet is deflected onto a discharge track 18 with an overhead fusing-in device 19 for fixing the received image.

In the circumferential direction of the drum 10 and in the direction of rotation there are provided downstream of the strippers 17 a purging device 20 and a corona charging station 21 for sensitizing the photoconductive layer on the drum 10.

Copying machines of this type include all means, likewise driving arrangements, as described e.g. in the references cited above in the introduction of the present specification.

Figure 2:
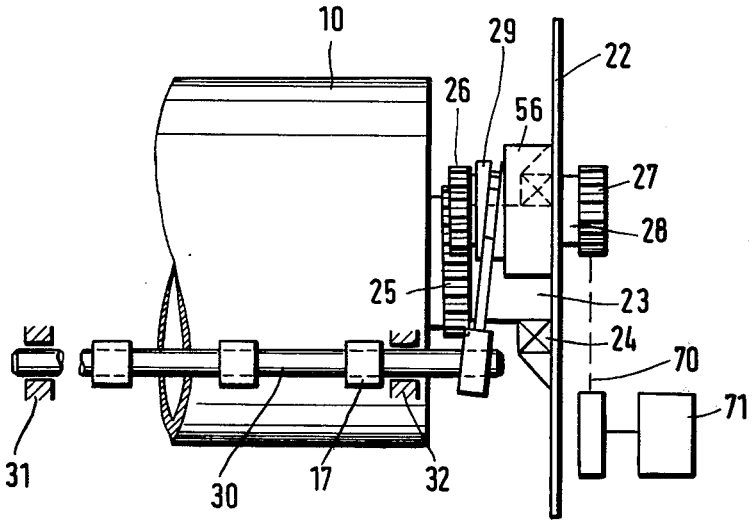
FIG. 2 is a fragmentary sectional view of FIG. 1, for explaining the drum mounting of the drive means and the arrangement of the cam disc.

In FIG. 2 is shown a side plate 22 that is arranged within the housing 2 parallel of the plane of the drawing of FIG. 1 and with which is associated another side plate along the other longitudinal side wall of the housing.

Figure 3:
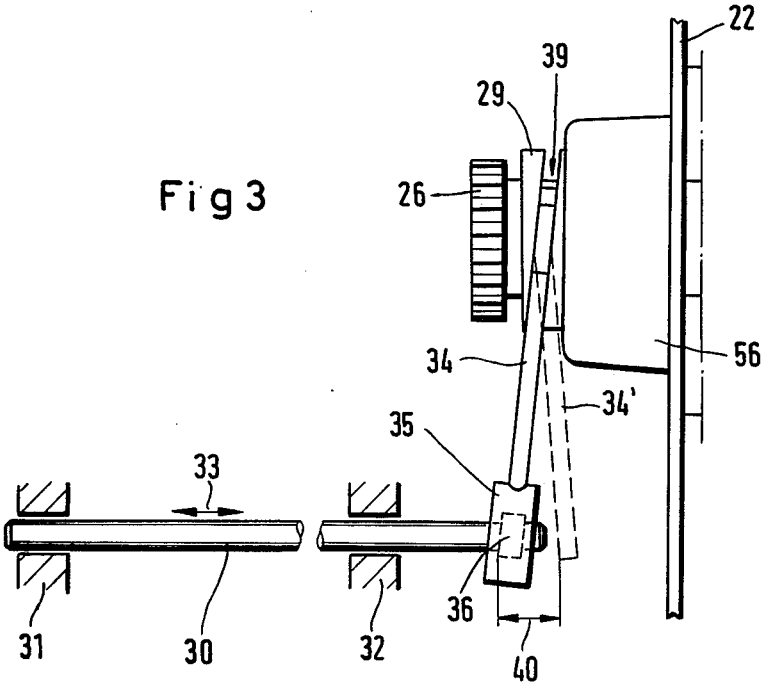
FIG. 3 is a fragmentary view of FIG. 2.

By a trunnion 23 the drum 10 is journalled in a bearing 24 at the side plate 22, and in a corresponding manner at the other side plate 22'. The drum 10 includes a drive gear 25 meshing with another drive gear 26 which is driven by a gear 27 mounted externally of the side plate 22, e.g. by a chain drive drive 70 and a motor 71. The gear 27 constitutes a driving arrangement for the transfer image carrier 10. The drive gear 26 is arranged at the outer casing of a planetary gear assembly 56, for providing a corresponding rotary speed reduction ratio. A control disc 29 shown more clearly in FIG. 3 is connected to the drive shaft 28 of the planetary gear assembly 56. It should be pointed out that separate drive means may be provided for the control disc 29 and the drive gear 25 whereby particularly the drive means for the control disc may be controllable for adjusting a predetermined rotary speed ratio by which will be avoided re-tracing of the strippers along the drum surface.

With respect to FIG. 1 there should initially be pointed out that the strippers 17, of which several are provided side by side in the axial direction of the drum 10, are arranged pivotably on an axis 30. This axis 30 is likewise shown in FIG. 3. This axis 30 is reciprocatingly journalled according to the double-headed arrow 33, in the vicinity of its ends, in bearings 31, 32 that are stationarily arranged within the housing 2 laterally of the drum 10 or at the side plates respectively. One end of this axis is engaged by a fork 34 constituting a guide member for the axial movement of the axis 30. This fork straddles, by a cage 35, movably but in a positive engagement, a radial profiling 36 arranged on the axis 30. The fork is guided, by its fork arms 37, 38 (FIG. 4) within a guide slot 39 of the control disk 29 which consists of a cam disc. The width of the fork arms 37, 38 engaging the guide slot 39 is selected so that the fork will be retained in an alignment that corresponds to the configuration of the guide slot 39. During rotation of the cam disc 29 according to FIG. 3 the fork is moved between the position shown in solid lines and indicated by 34 and a position shown in FIG. 3 in dashed lines and indicated by 34'. Thereby results a longitudinal shift 40 of the axis 30, for the reciprocating movement of the strippers 17.

Figure 4:
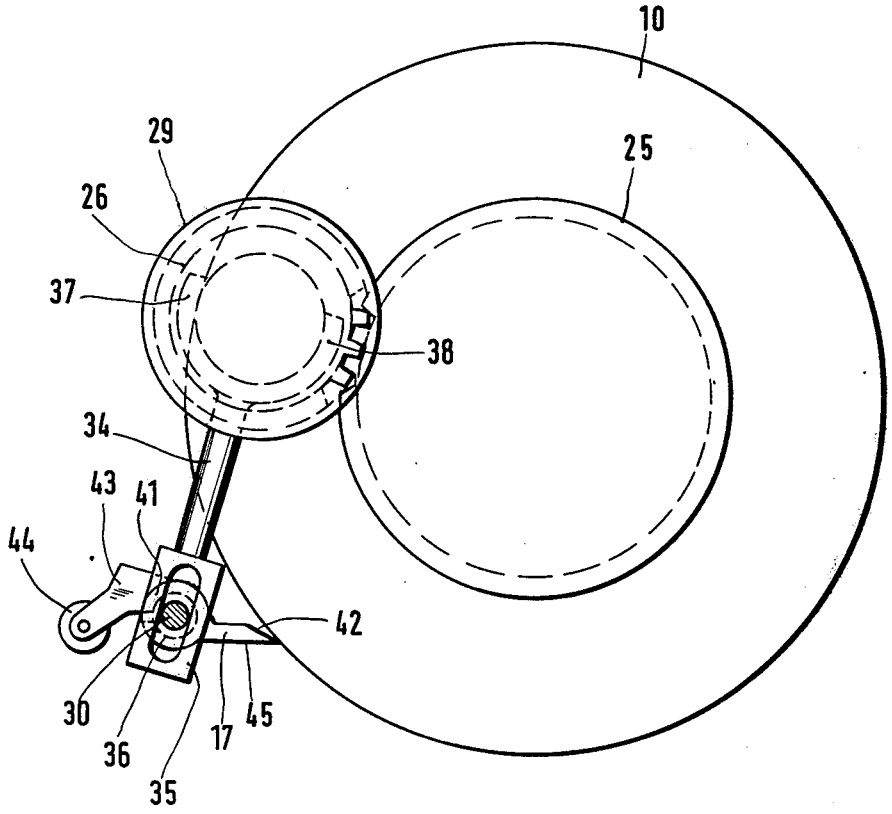
FIG. 4 is a schematical lateral elevational view of the drum, of the drive means therefor and of the mounting of the strippers.

In FIG. 4 may be seen that the strippers 17 of which several are disposed side by side may be pivoted about the axis 30. The strippers are mounted by clamping rings 41, with a clearance in the axial direction of the axis, whereby clamping rings of this type may likewise serve to secure the cage 35 at the axis 30. The strippers 17 themselves include engagement ends with a bevel portion 42 ensuring a smooth and virtually transition-free engagement with the wall surface of the drum 10. Furthermore the surface 45 of the stripper is specially finished since the edge of the receiving sheet is being carried away by this surface as smoothly and with as little friction as possible.

The strippers themselves include, furthermore, extensions 43 on which are provided counter-weights that are optionally slidably movable or in the form of wheels 44 that are differently arranged about their circumference, for a sensitive fine adjustment of the engaging pressure. In the embodiment as toothed wheels, these wheels serve still another purpose which is explained below. In the case of the further purpose either the extension itself defines the counter-weight, or another counter-weight may be attached to the extension.

The preferred embodiment according to FIGS. 5–8 will now be described. Similar or corresponding parts are indicated by the same reference numerals as in the already described figures.

In FIG. 5 is shown a view from the left hand side with respect to FIG. 8 whereby, however, all parts that are arranged in the view of FIG. 5 in front of the elements that are essential to the support of the axis 30 are shown only in broken lines. These elements are the drum 10, the drive gear 25 arranged on this drum and the lateral trunnion 46 of the drum which is releasably retained within a lateral extension 47 at the side plate 22 in a bearing recess 48 by clamping means 49. In this bearing extension is disposed, in virtual axial alignment, a trunnion 50 on which is pivotably mounted a swivel arm 51. The swivel arm bears at its left end in FIG. 5 the axis 30, and a corresponding swivel arm is likewise disposed on the opposite side of the drum 10 and receives on that side the other end of the axis 30. A part of this other swivel arm 61 is shown in FIG. 6. The swivel arms 51 have at their ends facings away from the axis 30 an extension 52. This extension underlies an abutment 53 that is defined on the extension 47. The abutment surface is indicated by 54, and the extension 52 is supported by this abutment surface by means of an adjustment screw 55 extending through the extension 52. In this manner the direction of the swivel arm 51 and the direction of the other swivel arm not shown may be adjusted precisely.

On the side plate 22 is arranged the control disc 29 on an output shaft of the planetary gear assembly 56, in a relationship with respect to the extensions 47, as may be seen in FIG. 5 or FIG. 6 respectively. The forked end of a fork 34 engages the guide slot 39 of the control disc whereby the fork arms 37, 38 extend through 180° and are therefore retained by their resilient force against the bottom of the guide slot 39.

In the embodiment according to FIGS. 5–8 the fork 34 is connected to the swivel arm 51. With reference to FIG. 7, a lateral lug-type projection 57 extends from this swivel arm 51. The lower end of the fork 34 straddles the swivel arm by three webs extending in the prolongation of the fork and being mutually displaced so that with respect to FIG. 1 one web 58 extends downwardly behind the swivel arm whereas the two other webs 59, 60 with respect to FIG. 5 extend downwardly at the front of the swivel arm and straddle between themselves the lug-type projection. Since the projection 57 may move between the webs 59, 60, an adjustment of the direction of the swivel arm 51 may be effected by the adjustment screw 55. This connection between the fork 34 and the swivel arm 51 is preferred because in this manner, even when reversing the direction of reciprocating movement, a dead position is substantially avoided.

Strippers 17, 17' are arranged on the axis 30 in the described manner. These strippers include extensions 43 inclined downwardly, and a toothed wheel 62 that is freely rotatable is mounted at the end of each extension. In the region of the pivot mounting of the strippers 17 on the axis 30 there is likewise arranged a toothed wheel 63. This toothed wheel is of a diameter so as to project downwardly beyond the downwardly facing stripper surface 64 and the end portions of the swivel arm 51. The toothed wheels 62, 63 are mounted so as to be easily rotable. In combination with the low surface contact pressure of the stripper 17 against the surface of the drum 10 it will be achieved that a receiving sheet moves along the highly finished stripper surface 64, is taken up by the toothed wheel 63 and arrives subsequently at the toothed wheel 62. The inherent rigidity of the receiving sheet pivots the stripper 17 about the axis 30 clockwise with respect to FIG. 5 so that in this manner, during the passage of a receiving sheet, the stripper will be lifted off the wall surface of the drum 10.

The mountings of the bearing arms 51, 61 on their trunnions 50 and on the axis 30 in these swivel arms include a sufficient clearance for permitting the reciprocating movement.

In operation of the machine, the strippers 17 which may comprise for example three strippers reciprocate along the axial length of the drum 10 under the control of the slot in the cam disc 29 so that no circumferential traces may be scratched into the drum whereby, furthermore, the transmission ratio between the drive member of the drum 10 and the drive member of the axis 30 is selected so that the intersections of the traces resulting from this reciprocating movement are evenly distributed about the circumference of the drum or respectively are continuously displaced in the circumferential direction of the drum.

Figure 9:
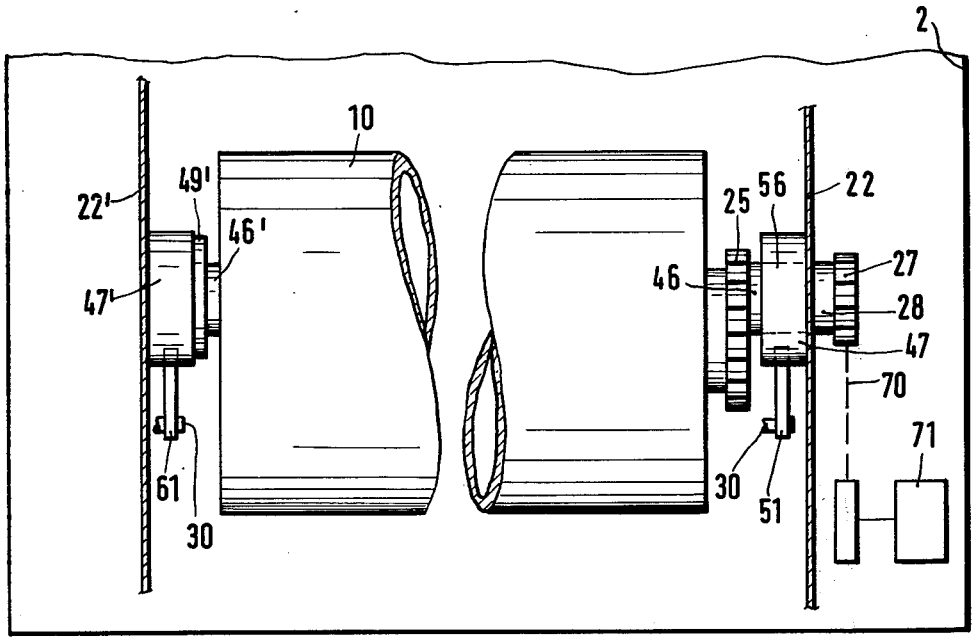
FIG. 9 is a schematical longitudinal view of the drum assembly according to FIG. 5.

FIG. 9 is a longitudinal view of the drum 10 for showing that within the housing 2 are arranged two side plates 22, 22' spaced from the lateral housing walls. In FIG. 9 the bearing and support members are indicated by the same reference numerals but with an appended dash with respect to the members associated with the side plate 22'. Similar parts as in the preceding figures are likewise indicated by the same reference numerals.

What is claimed is:

1. An apparatus for peeling off the leading edge of a receiving sheet from an electrostatically chargeable transfer image carrier that is mounted for movement in a feed direction in a copying machine comprising first drive means for driving the transfer image carrier in the feed direction; guide means for feeding a receiving sheet to the transfer image carrier; at least one stripper mounted to at least temporarily engage the transfer image carrier prior to the approach of the leading edge of the receiving sheet, said stripper being pivotally mounted to enable it to be lifted off said image carrier; mounting means for said at least one stripper; and second drive means operatively associated with said first drive means for oscillating said stripper transversely of the feed direction while said stripper is engaged with said transfer image carrier.

2. An apparatus as defined in claim 1, wherein said transfer image carrier is in the form of a rotatably driven drum having a coating for generating, by an exposure, a latent image adapted to be developed, particularly by an electro-photographical process, and wherein said at least one stripper is mounted on an axis extending parallel to said drum and reciprocable with respect thereto.

3. An apparatus as defined in claim 2, wherein said second drive means includes a cam disc mounted on a drive shaft, the drive shaft being coupled to said first drive means in a predetermined driving relationship, a cam disc, and a guide member for said reciprocating stripper guided by the cam disc.

4. An apparatus as defined in claim 3, wherein said cam disc includes a guide slot that is inclined with respect to the axis of said cam disc, a fork being provided which is movably connected to said axis and adapted to reciprocate said axis under the control of the rotating cam disc.

5. An apparatus as defined in claim 2, wherein said axis is mounted on swivel arms, said swivel arms having associated abutments, the position of said swivel arms being adapted to be adjusted by means of an associated adjustment screw.

6. An apparatus as defined in claim 2, wherein said at least one stripper is pivotably mounted on said axis with an extension of said stripper facing away from said drum being adapted to cause an engagement with the circumference of said drum.

7. An apparatus as defined in claim 5, wherein there are provided abutments and associated adjustment screws for moving said swivel arms at their ends bearing said at least one stripper in the sense of rotation of the periphery of said drum.

8. An apparatus as defined in claim 2, wherein said axis is reciprocally mounted in bearings, and wherein a plurality of said strippers are mounted on said axis.

9. An apparatus as defined in claim 6, wherein a toothed wheel is arranged at the extension opposite the stripper with respect to said axis, with a stripped receiving sheet engaging said toothed wheel and during the sheet passage effecting lifting of said stripper away from said drum wall due to the stiffness of said sheet.

10. An apparatus as defined in claim 9, wherein an additional toothed wheel associated with each stripper in the region of its pivot mounting on said axis projects beyond said downwardly facing stripper surface along which said receiving sheet is being removed.

11. An apparatus as defined in claim 4 wherein said connection of said opposite end of said fork is a swivel connection.

12. An apparatus as defined in claim 4, further including at least one swivel arm having said axis connected thereto, and wherein said fork is connected to said swivel arm by a connection permitting vertical movements between said fork and said swivel arm.

13. An apparatus as defined in claim 12, wherein said connection between said swivel arm and said fork includes a web on one side of said swivel arm, two spaced webs on the opposite side of said swivel arm, and a projection of said swivel arm movable between said webs.

14. An apparatus as defined in claim 3, wherein said drive shaft is adapted to be driven in dependence upon the rotary speed of said drum.

* * * * *